United States Patent [19]

Sprengers

[11] Patent Number: 4,825,128

[45] Date of Patent: Apr. 25, 1989

[54] COMPACT DISCHARGE LAMP WITH CONDUCTIVE COATING CAPACITVELY COUPLED TO HIGH FREQUENCY SUPPLY

[75] Inventor: Leo M. Sprengers, Turnhout, Belgium

[73] Assignee: U.S. Phillips Corporation, New York, N.Y.

[21] Appl. No.: 109,807

[22] Filed: Oct. 16, 1987

[30] Foreign Application Priority Data

Oct. 22, 1986 [NL] Netherlands ..... 8602643

[51] Int. Cl.[4] ..... H05B 41/24

[52] U.S. Cl. ..... 315/58; 313/318; 313/635; 315/71; 315/85; 439/616; 439/619

[58] Field of Search ..... 315/58, 71, 85, 234, 315/335, 227 R; 313/318, 634, 635; 439/375, 611, 616, 619

[56] References Cited

U.S. PATENT DOCUMENTS 4,406,975 9/1983 Nixon ..... 315/58 X 4,565,944 1/1986 Beurskens et al. ..... 439/616 X 4,636,691 1/1987 De Man et al. ..... 315/58 X 4,727,294 2/1988 Houkes et al. ..... 315/57 X

*Primary Examiner*—David K. Moore

*Assistant Examiner*—Mark R. Powell

*Attorney, Agent, or Firm*—Thomas A. Bridody; Jack E. Haken; Emmanuel J. Lobato

[57] ABSTRACT

The assembly has a low-pressure sodium discharge lamp (1), of which the outer envelope (4) has an electrically conducting coating (5), which is connected through a capacitor (29) to one of the current supply conductors (13) to the light source (3) of the lamp (1) and to the neutral conductor (18) of the power supply (2), which supplies an alternating voltage having a frequency of at least 80 kHz. The lamp holder (23) has an eccentrically arranged projection at its inner surface while the lamp cap (6) has an eccentrically arranged recess at its outer surface, which, when the lamp cap (6) is arranged in the lamp holder (23), engage with each other and guarantee a connection of the capacitor (29) to the neutral conductor (18). The lamp (1) is suitable for operation at mains voltage frequency and is still fitting into the lamp holder of mains voltage frequency equipment.

6 Claims, 1 Drawing Sheet

COMPACT DISCHARGE LAMP WITH CONDUCTIVE COATING CAPACITVELY COUPLED TO HIGH FREQUENCY SUPPLY

BACKGROUND OF THE INVENTION

The invention relates to an assembly of a low-pressure sodium discharge lamp and a feeding apparatus, in which the low-pressure sodium discharge lamp has a light source, which is arranged in an evacuated outer envelope, whose inner surface is provided with a translucent electrically conducting coating and to which a Swan lamp cap is secured, which has at its base portion insulated contacts, from which current supply conductors extend to the light source, which light source has a discharge vessel which is filled with an ionizable sodium-containing filling, the feeding apparatus supplies an alternating voltage having a frequency of at least 80 kHz and is provided with a Swan lamp holder, which has at its base portion insulated contacts, one of which is connected to a neutral conductor and another is connected to an above ground conductor of the feeding apparatus. The invention also relates to a low-pressure sodium discharge lamp and a lamp holder suitable for use in the assembly. Such an assembly is known from GB No. 2 134 701 and corresponding U.S. Pat. No. 4,636,691.

The known low-pressure discharge lamp can be operated at an alternating voltage having the frequency of the mains voltage (for example 50 or 60 Hz), but has a higher efficiency if it is operated at a voltage having a frequency of at least 80 kHz.

It has been found that lamps operated at a voltage having such a high freqency have an electric field which disturbs radio reception.

The invention has for its object to provide an assembly of a low-pressure sodium discharge lamp and a feeding apparatus, of which the radio disturbance during operation of the lamp at high-frequency voltage is suppressed, while the lamp can also be used in conjunction with a conventional feeding apparatus supplying an alternating voltage at mains frequency.

SUMMARY OF THE INVENTION

According to the invention, this object is achieved in an assembly, and in a lamp suitable for use in this assembly, of the kind mentioned in the opening paragraph in that one of the current supply conductors is connected within the outer envelope of the lamp via a capacitor to the translucent electrically conducting coating, the Swan lamp cap has in its outer surface an eccentrically arranged recess, and the Swan lamp holder has as its inner surface an eccentrically arranged projection, which engages the recess in the Swan lamp cap, the said one current supply conductor being connected to the neutral conductor of the feeding apparatus.

It has been found that the disturbance of radio reception is effectively suppressed during high-frequency lamp operation when the translucent electrically conducting coating is connected through a capacitor to the lamp current supply conductor which is connected in use to the neutral conductor of the feeding apparatus or power supply. When the recess and the projection of cooperating with each other are arranged eccentrically, it is guaranteed that, when the lamp is arranged in the Swan lamp holder, the neutral contact of the lamp holder gets into contact with the contact of the Swan lamp cap to which the one current supply conductor is connected.

The low pressure sodium discharge lamp of the assembly according to the invention, however, is also suitable to be operated in a conventional manner at mains frequency of, for example, 50 or 60 Hz. Due to the measure taken with respect to the lamp cap of the lamp, the lamp still fits with its lamp cap into the Swan lamp holder of a conventional feeding apparatus in each of the two positions with respect to said lamp holder. Nevertheless, the lamp can be connected to a high-frequency feeding apparatus of the assembly according to the invention solely in the only correct manner in one single position.

The invention therefore also relates to a low-pressure sodium discharge lamp, one of whose current supply conductors is connected within the outer envelope of the lamp via a capacitor to the translucent electrically conducting coating and to a Swan lamp cap with a recess eccentrically arranged in its outer surface. The invention also relates to a Swan lamp holder with a projection eccentrically arranged at its inner surface.

In order to prevent gas or vapor from being released from the capacitor, which reduces the vacuum in the outer envelope, use is preferably made of a ceramic capacitor. In general, a capacitor of about 5 nF or more is sufficient. Radio disturbance is then suppressed to an extent which is comparable with that which is obtained when the coating is directly connected to earth. However, when the coating is earthed, this involves a very complicated structure of the lamp, inter alia an additional vacuum-tight lead-through of a conductor through the wall of the outer envelope.

BRIEF DESCRIPTION OF THE DRAWING

An embodiment of the assembly, the lamp and the lamp holder according to the invention are shown in the drawing. In the drawing.

DETAILED DESCRIPTION OF THE INVENTION

Figure 1:
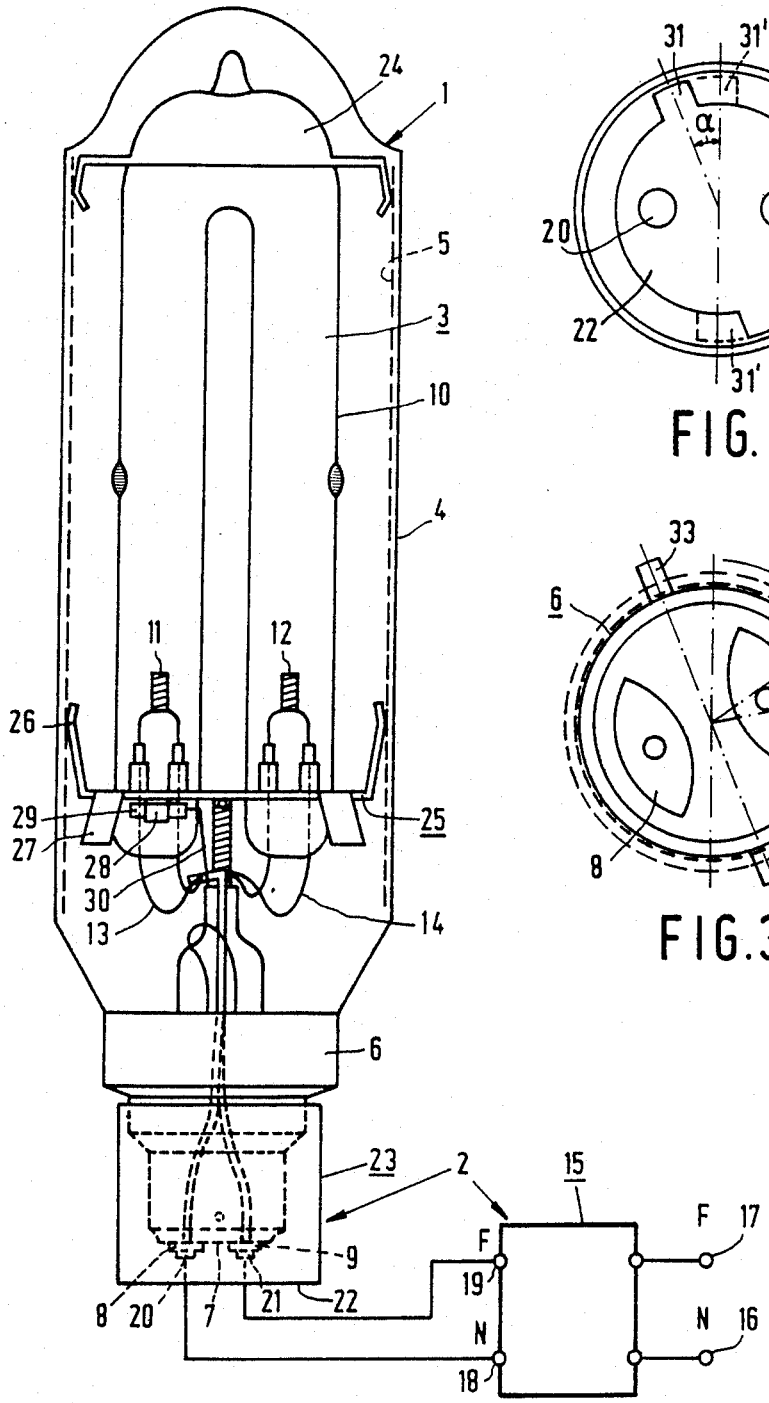
FIG. 1 shows an assembly with a lamp in side elevation and a diagrammatically indicated feeding apparatus.

In FIG. 1, the assembly comprises a low-pressure sodium discharge lamp 1 and a feeding apparatus or power supply 2, the lamp 1 having a light source 3 arranged in an evacuated outer envelope 4. The outer envelope 4 has at its inner surface a translucent electrically conducting coating 5, which reflects infrared radiation and consists, for example, of tin-doped indium oxide. A Swan lamp cap 6, which has at its base portion 7 insulated contacts 8, 9, and projections or lugs 33 extending laterally from it, is secured to the outer envelope 4.

The light source 3 has a discharge vessel 10, which is filled with an ionizable sodium-containing filling. Electrodes 11, 12 are arranged in the discharge vessel 10. Current supply conductors 13, 14 extend therefrom to a respective contact 8, 9 at the lamp cap 6.

The feeding apparatus comprises a frequency converter 15 having an input terminal 16 for connection to the neutral conductor (N) of a mains voltage source and an input terminal 17 for connection to the above ground conductor (F) thereof. The output terminals 18 (N) and 19 (F), respectively, of the frequency converter 15 are connected to the contacts 20 and 21, respectively, at the base portion 22 of a diagrammatically indicated Swan lamp holder 23, as a result of which the current supply conductor 13 of the lamp 1 is connected to the neutral conductor 18 of the feeding apparatus 2. The feeding apparatus or power supply 2 supplies an alternating voltage having a frequency of at least 80 kHz.

The discharge vessel 10 is held positioned in the outer envelope 4 by a hood-shaped support 24 and by a plate 25, which has tags 26 and 27, which bear against the coating 5. By means of a bracket 28 stamped out of this plate 25, a ceramic capacitor 29 is connected mechanically and electrically to the plate 25 and is therefore also elecrically connected through the tags 26, 27 to the coating 5. The capacitor 29 is connected on the other hand through a conductor 30 and the current supply conductor 13 to the neutral conductor 18 of the feeding apparatus 2.

Figure 2:
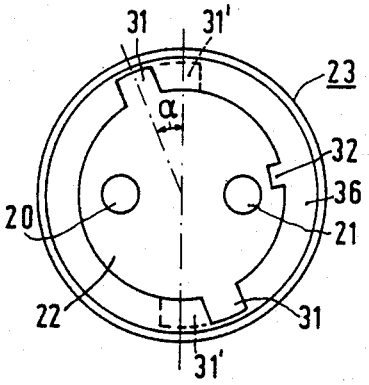
FIG. 2 is the plan view of the Swan lamp holder shown in FIG. 1.
Figure 3:
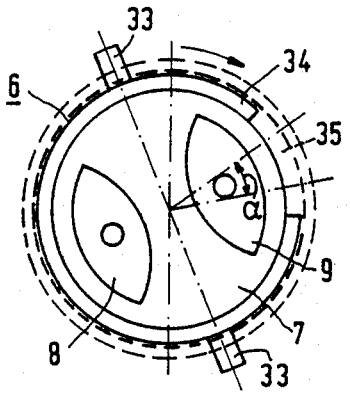
FIG. 3 is the bottom view of the Swan lamp cap shown in FIG. 1.

The lamp cap 6 and the lamp holder 23 of FIG. 1 have the particulars, which are shown in FIGS. 2 and 3. In FIGS. 2 and 3, parts designated in FIG. 1 are provided with the same reference numerals.

In FIG. 2, the Swan lamp holder has in its cylindrical wall portion 36 recesses 31, 31', which are adapted to receive a respective projection 33 of the Swan lamp cap 6 (FIG. 3) and to cause it to cover therein an L-shaped path when the lamp can 6 is inserted into the lamp holder. The recesses 31, 31' permit a rotation through an angle $\alpha$. Unconventionally, the Swan lamp holder 23 is provided with an eccentrically arranged projection 32 at its inner surface, as a result of which conventional lamp caps do not fit any longer. In the Figure, the projection 32 is situated at the cylindrical wall portion 36.

The Swan lamp cap 6 of FIG. 3 has an eccentrically aranged recess 35, which, when the lamp cap 6 is arranged in the lamp holder 23, engages the projection 32 (FIG. 2) and permits a rotation of the lamp cap 6 in the lamp holder 23 through an angle $\alpha$. The recess 35 is situated in a cylindrical wall portion 34 of the lamp cap 6. The recess shown is a straight longitudinal groove, which extends from the base portion 7. However, the groove could have been L-shaped, such as 31, 31' in FIG. 2.

Due to the presence of the projection 32, the lamp cap 6 can be arranged in the holder 23 only in one position, i.e. that in which the contact 8 is in contact with the contact 20 and in which therefore the coating 5 (FIG. 1) is in connection via the capacitor 29 with the neutral conductor 18 of the feeding apparatus 2. The projection 32 and the recess 35 together jointly comprise orienting means for orienting the lamp cap 6 relative to the lamp holder 23 so that the lamp contact 8 is always in contact with the holder contact 20.

In spite of the modification of the Swan lamp cap 6, the lamp 1 can be arranged with this lamp cap 6 in the conventional Swan lamp holder (without projection 32) of a conventional feeding apparatus or power supply supplying an alternating voltage of mains frequency, for which alternating voltage the lamp 1 is also suitable.

It has been found that in an experimental arrangement a low-pressure sodium discharge lamp of 36 W emits during operation at 600 kHz a disturbance radiation, which yields an antenna voltage of 44 dB/$\mu$V. If in an otherwise unchanged arrangement the electrically conducting coating of the lamp is earthed, the antenna voltage decreases to 4 dB/$\mu$V and with the use of a capacitor of 10 nF in the outer envelope described to 6 dB/$\mu$V. It has been found that in the experimental arrangement an antenna voltage of 24 dB/$\mu$V is acceptable.

What is claimed is:

1. In the combination of a low-pressure sodium dischage lamp and a power supply for operating the lamp, in which the low-pressure sodium discharge lamp has a light source arranged in an evacuated outer envelope, the outer envelope has at its inner surface a translucent electrically conducting coating and to which a lamp cap is secured, which lamp cap has insulated base contacts from which current supply conductors extend to the light source, which light source has a discharge vessel filled with an ionizable sodium-containing filling, and the power supply supplies an alternating voltage having a frequency of at least 80 kHz and is provided with a lamp holder which has at its base portion insulated contacts, one of which is connected to a neutral conductor and another contact is connected to an above ground conductor of the power supply, the improvement comprising:

a capacitor connecting one of the current supply conductors within the outer envelope of the lamp to the translucent electrically conducting coating, the lamp cap having in its outer surface an eccentrically arranged recess and the lamp holder having at its inner surface an eccentrically arranged projection, which engages the recess in the lamp cap, the said one current supply conductor being connected to the neutral conductor of the power supply.

2. A low-pressure sodium discharge lamp suitable for use in the combination claimed in claim 1 and provided with a light source arranged in an evacuated outer envelope, which has as its inner surface a translucent electrically conducting coating and to which a lamp cap is secured, which lamp cap has at its base portion insulated contacts from which current supply conductors extend to the light source, which light source has a discharge vessel, which is filled with an ionizable sodium-containing filling, characterized in that one of the current supply conductors is connected within the outer envelope of the lamp through a capacitor to the translucent electrically conducting coating and the lamp cap has in its outer surface an eccentrically arranged recess.

3. A lamp holder suitable for use in a combination claimed in claim 1, characterized in that the lamp holder has at its inner surface an eccentrically arranged projection.

4. In a low-pressure sodium discharge lamp of the type having an evacuated outer envelope, a discharge vessel within said outer envelope and containing a quantity of a sodium-containing filling, a translucent electrically conductive coating disposed on an inner surface of said outer envelope, a lamp cap attached to said outer envelope and having insulated contacts for receiving an operating voltage for operating said lamp, and conductors each extending from a respective one of said contacts to said discharge vessel for applying to said discharge vessel the operating voltage applied to said lamp cap, the improvement comprising:

one of said insulated contacts and the respective one of said conductors being intended for connection to the neutral conductor of a high frequency voltage supply for operating the low-pressure sodium discharge lamp; and a capacitor within said outer envelope connected between said conductive coating and said respective one of said conductors and having a value effective to establish a conductive path between said conductive coating and the neutral conductor of a high frequency supply during lamp operation in order to reduce radio frequency interference.

5. The combination of a low-pressure sodium discharge lamp according to claim 4, with a lamp holder for receiving said lamp cap, said lamp holder having contacts corresponding to said insulated contacts of said lamp cap, and said lamp holder and said lamp cap jointly comprising orienting means for orienting said lamp cap relative to said lamp holder so that said lamp cap contact connected to said capacitor is always in contact with the same preselected contact of said lamp holder when said lamp cap is mounted in said lamp holder.

6. The combination according to claim 5, wherein said insulated contacts are mounted on an end of said lamp base, and said orienting means is comprised of a pin internally protruding into said lamp holder and a recess in the lateral wall of said lamp cap for receiving said pin when said lamp cap is properly oriented in said lamp holder and for interfering as said lamp cap and lamp holder are relatively oriented away from the proper orientation.

* * * * *